United States Patent [19]

Kerry

[11] Patent Number: 4,581,903

[45] Date of Patent: Apr. 15, 1986

[54] INTERCHANGEABLE SUCTION ACCUMULATOR AND FILTER-DRIER

[76] Inventor: Harry Kerry, 5599 - 24th Ter. North, St. Petersburg, Fla. 33710

[21] Appl. No.: 644,180

[22] Filed: Aug. 23, 1984

[51] Int. Cl.[4] ..... F25B 43/00

[52] U.S. Cl. ..... 62/503; 62/298; 62/326; 62/474

[58] Field of Search ..... 62/503, 474, 475, 298, 62/326; 210/DIG. 6

[56] References Cited

U.S. PATENT DOCUMENTS

| | | | |
|---|---|---|---|
| 2,556,292 | 6/1951 | Newcum | 62/474 |
| 3,837,173 | 9/1974 | Kuttruff et al. | 62/503 |
| 4,199,960 | 4/1980 | Adams et al. | 62/503 |

*Primary Examiner*—Ronald C. Capossela

*Attorney, Agent, or Firm*—Stein, Reese and Prescott

[57] ABSTRACT

An interchangeable suction line filter-drier and accumulator comprising a vessel having an inlet and an outlet, a removable filter-drier element, and a removable non-porous evaporator conduit which interchangeably functions as a filter-drier when the filter-drier is installed or as a suction accumulator when the non-porous evaporator is installed.

8 Claims, 4 Drawing Figures

INTERCHANGEABLE SUCTION ACCUMULATOR AND FILTER-DRIER

BACKGROUND OF THE INVENTION

1. Field of the Invention

This invention relates to suction accumulators for use in conjunction with vapor compression heat transfer systems such as air conditioning systems and heat pumps. This invention also relates to suction line filter-driers for use in conjunction with such vapor compression heat transfer systems.

2. Description of the Background Art

Conventional vapor compression heat transfer systems comprise a compressor, condenser, throttling device, and evaporator connected in serial fluid communication with one another. The system is charged with a refrigerant which circulates through each of the components to remove heat from the evaporator and transfers such heat to the condenser. During operation, the compressor compresses the refrigerant from a saturated-vapor state to a super-heated vapor state thereby increasing the temperature, enthalpy, and pressure of the refrigerant. The refrigerant then flows through the condenser which condenses the refrigerant at a substantially constant pressure to a saturated-liquid state. The throttling device reduces the pressure of the refrigerant thereby causing the refrigerant to change to a mixed liquid-vapor state. The refrigerant then flows through the evaporator which causes the refrigerant to return at a constant pressure to its saturated-vapor thereby completing the thermal transfer cycle.

It has been long recognized, under some operating conditions, that the evaporator may not sufficiently function to completely evaporate the liquid refrigerant following from the condenser. When incomplete evaporation occurs, liquid refrigerant flows into the compressor and causes great damage to the compressor. Devices, generally known as suction accumulators or surge drums, have been developed to prevent such liquid floodback of the refrigerant to the compressor, and are used in conjunction with virtually all systems employing flooded-type evaporators. One of the most widely used accumulators basically consists of a cylindrical shell having an inlet positioned in the upper portion of the shell and connected to the suction line from the evaporator. The outlet is connected to an upstanding U-shaped tube internal to the shell and is connected to the suction line to the compressor. During use, the refrigerant flows into the shell via the inlet and, because of the upstanding U-shaped tube, only vaporized refrigerant is allowed to flow via the tube and outlet to the compressor. All of the liquid refrigerant is consequently accumulated in the bottommost portion of the shell. U.S. Pat. Nos. 3,084,523, 3,212,289, 3,344,506, 3,420,071, 3,432,910, 3,443,367, 3,589,395, 3,643,465, 3,837,177 and 3,872,689, the disclosures of each of which are hereby incorporated by reference herein, illustrate various embodiments of conventional suction accumulators.

It has also been long recognized that moisture and other impurities may enter the heat transfer system when the circuit is opened for repair or maintenance. Suction line filter-driers have been developed to be connected in the suction line of the system to remove such moisture and other impurities. Conventional filter-driers consist of a shell having an inlet and an outlet. A desiccant, such as moisture-absorbing silica gel, and a screen are positioned within the shell to remove the moisture and particulate impurities from the refrigerant as the refrigerant flows through the filter-drier and before the refrigerant enters the compressor. After the moisture and other impurities have been dried and filtered from the refrigerant gas, the filter-drier has served its purpose and should be removed from the system. Unfortunately, the sealed type of filter-drier cannot be removed from the suction line without cutting into the system and, again, exposing it to moisture and other contaminates. Consequently, the sealed type filter-driers are usually left in the system even after they have accomplished their intended purpose.

Replaceable core type filter-driers have recently been developed which allow the removal of the filter elements from the shell after the refrigerant has been sufficiently filtered and dried. These replaceable core filter-driers typically comprise a shell in which are positioned one or more filter elements. Access is provided to the shell by means of a flange cover bolted to a flange integral with the shell itself. A more detailed description of these replaceable core filter-driers can be found in Bulletin 14.50T published September, 1974 by the ALCO Controls Division of Emerson Electric Company, St. Louis, Mo. and by Bulletin 40-10, published in December, 1978 by Sporlan Valve Company, St. Louis, Mo., the disclosures of each of which are hereby incorporated by reference herein.

It is apparent that both the suction accumulator devices and the filter-drier devices perform extremely useful functions in connection with vapor cycle heat transfer systems. However, the need for two seperate devices significantly adds to the overall cost of the system because of the cost of the devices themselves, and the labor and materials costs in installing each of the devices in the system.

Therefore, it is an object of this invention to provide an apparatus which overcomes the aforementioned inadequacies of the prior art devices and provides an improvement which is a significant contribution to the advancement of the suction accumulator and suction filter-drier arts.

Another object of this invention is to provide a device which functions as a suction line filter-drier to remove moisture and other contaminates from refrigerant flowing through the circuit of a vapor compression heat transfer system.

Another object of this invention is to provide a device for preventing liquid refrigerant from flowing into the compressor of a vapor compression heat transfer system.

Another object of this invention is to provide a device which functions as a suction line filter-drier which may be conveniently interchanged to function as a suction line accumulator.

Another object of this invention is to provide an interchangeable suction line accumulator and filter-drier which is economical to manufacture and easily installed in new and existing vapor compression heat transfer systems.

Another object of this invention is to provide an interchangeable suction line filter-drier and accumulator which utilizes commercially available filter-drier blocks or cores having desiccant properties to remove moisture from the system and filter properties to remove impurities from the refrigerant such as dirt, acids, sludge and varnish.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises an interchangeable suction line filter-drier and accumulator. More particularly, the interchangeable suction line filter-drier and accumulator of the invention functions to filter and dry the refrigerant gas flowing into the compressor from the evaporator and, upon being interchanged, to then function as an accumulator to prevent liquid refrigerant from flowing into the compressor. The device of the invention bascially comprises an open-ended shell having a cover removably and sealingly affixed over the opened end. An inlet is provided in the upper portion of the shell and an outlet is provided at the bottommost portion. When used as a filter-drier, commercially available filter-drier core, having the desired properties, is inserted into the shell about an upstanding screen tube. A retaining member is positioned over the cores to secure them in place, and then the cover is affixed over the open end. As refrigerant flows through the vessel via its inlet and outlet, it is filtered and dried by the cores. After a period of time, usually twenty-four to forty-eight hours of operation when the refrigerant is cleaned of all moisture and impurities, the cores are removed and discarded.

To interchange the device, an accumulator tube is fitted over the length of the screen tube to form a tight seal with the bottom wall of the vessel. The device then operates as a suction accumulator by trapping all liquid refrigerant in the bottommost portion of the vessel while allowing all of the refrigerant gas to flow from the outlet of the vessel via the accumulator tube. A deflector may be affixed about the inlet to deflect the stream of the refrigerant toward the bottom of the vessel thereby enhancing the operation of the device as a suction accumulator.

It should be apparent that the interchangeable suction filter-drier and accumulator of the invention functions similar to conventional filter-driers and accumulators. However, unlike conventional units, the interchangeability of the device of the invention eliminates the need to install and maintain two separate devices. The overall costs of the system is, therefore, greatly reduced.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equilvalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
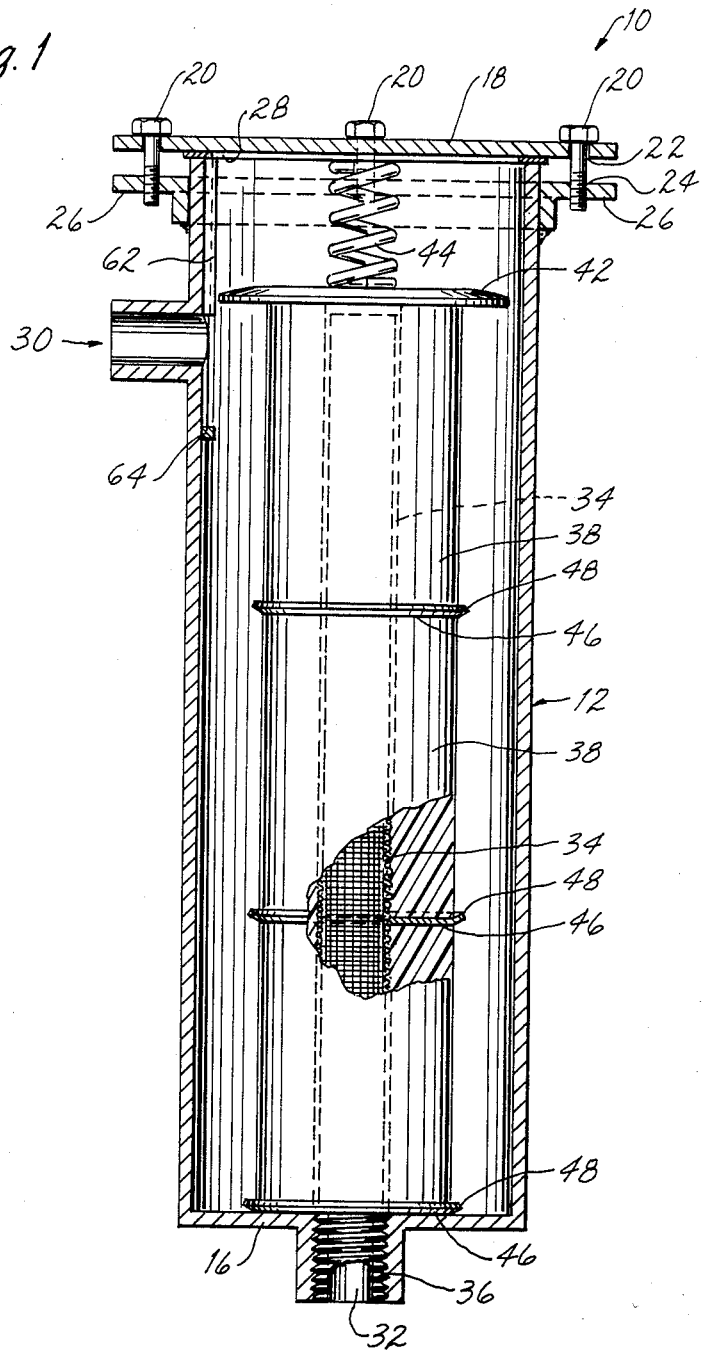
FIG. 1 is a longitudinal cross-sectional view of the device of the invention operating as a suction line filter-drier and illustrating, in partial cut-away, the filter cores installed therein.
Figure 2:
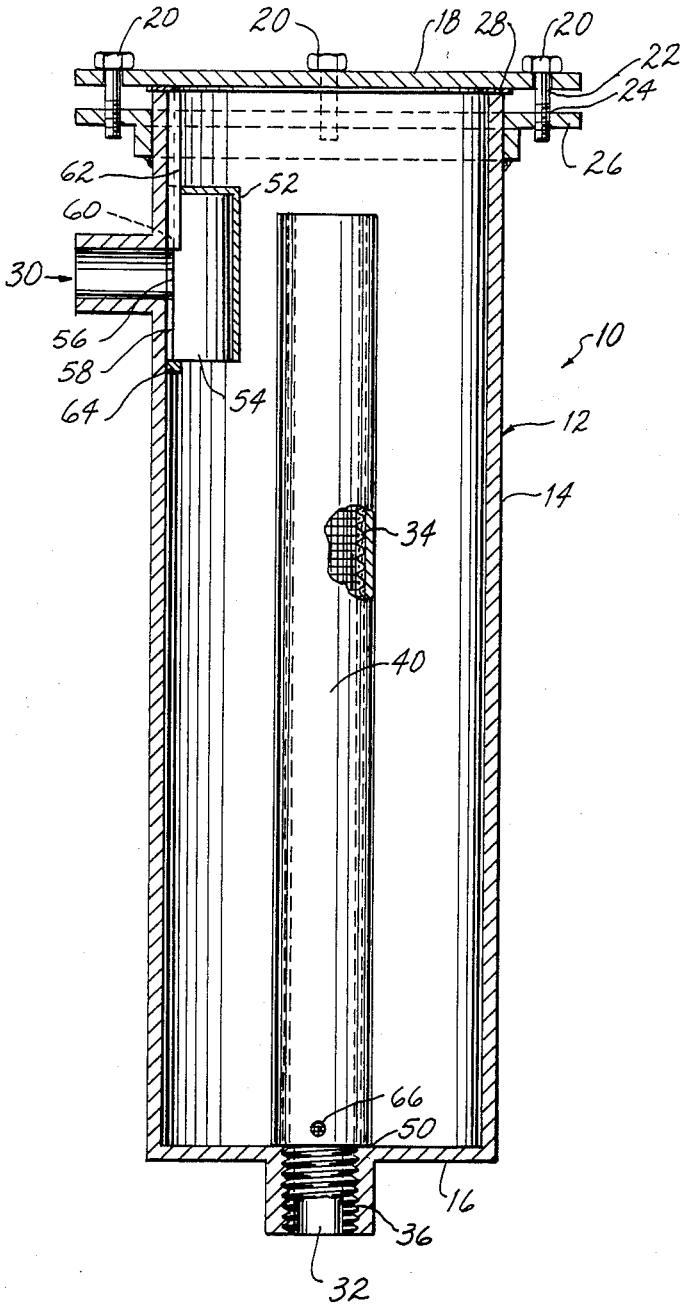
FIG. 2 is a longitudinal cross-sectional view of the device of the invention operating as a suction line accumulator with the evaporator tube and deflector installed therein.

FIGS. 1–2 illustrates the first embodiment of the device 10 of the invention which is operable in a vertical position as shown. More particularly, the device 10 of the invention comprises a substantially cylindrical vessel 12 having sidewall 14 and bottom wall 16. A cover 18 is removably and sealingly affixed to the opened end of the vessel 12 by means of threaded fasteners 20 which engage through apertures 22 in the cover 18 and apertures 24 positioned within an annular flange 26 welded to the upper portion of the side wall 14 if the vessel 12. A gasket 28 may be provided to assure proper sealing of the cover 18 to the upper edge of the side wall 14 of the vessel 12. It should be understood that the vessel 12 may comprise other configurations, for example, rectilinear, and that the cover 18 mau be affixed over the opened end of the vessel 12 by any suitable means.

An inlet 30 is rigidly connected at the upper region of the side wall 14 of the vessel 12 by means such as by welding. An outlet 32 is rigidly connected through bottom wall 16 of the vessel 12 by similar means. Both inlet and outlet 30 and 32 preferably comprise a cylindrical design and are dimensioned to be connected in-line with the suction line from the evaporator and the suction line to the compressor, respectively.

An upstanding screen tube 34 is centered within the vessel 12 in a position preferably concentric to outlet 32. Also preferably, screen tube 34 is connected to outlet 32 at threads 36. As will be explained later in greater detail, screen tube 34 functions as a means for centering the filter cores 38 when the device 10 of the invention is utilized as a filter-drier and then to support an evaporator tube 40 when the device 10 operates as a suction accumulator.

Referring specifically to FIG. 1, one or more of the filter cores 38 may be centered over the screen tube 34 in a stacked arrangement. A disk-shaped retainer plate 42 is then fitted on top of the stacked filter cores 38 to secure the filter cores 38 in their stacked position. A compression spring 44 may be positioned between the retainer plate 42 and cover 18 to more rigidly secure the filter cores 38 in the stacked configuration. A disk-shaped core support 46 having an upturned annular edge 48 may be positioned on the bottom end of each filter core 38 to still further provide rigid support for the filter cores 38.

With the filter cores 38 installed within the device 10 of the invention, the device 10 functions as a suction line filter-drier. Specifically, the refrigerant has which flows into the vessel 12 filters through the walls of the filter cores 38 and then through screen tube 34 to be discharged from the vessel 12 via outlet 32. All of the moisture and other contaminates in the refrigerant gas are, therefore, filtered by the filler cores 38 in the conventional manner. The retainer plate 12, the core supports 46 and the screen tube 34 provide sufficient support to the filter cores 38 to prevent disintegration of the cores 38 during use while, at the same time, allowing the refrigerant gas to flow through the walls of the filter cores 38 to be properly filtered.

Figure 2A:
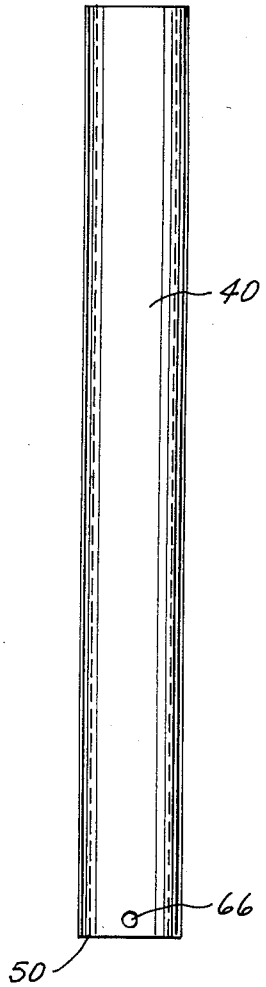
FIG. 2A is a plan view of the evaporator tube to be inserted into the device of the invention.

After the refrigerant gas is sufficiently filtered and dried, the contaminated filter cores 38 may be removed from the vessel 12 by unthreading the threaded fasteners 20 and removing cover 18. The device 10 may then be converted to a suction line accumulator. Specifically, referring now to FIGS. 2 and 2A, the evaporator tube 40, having an inside diameter only appreciably greater than the outside diameter of the screen tube 34, is slid over the screen tube 34 along its entire length until the bottom edge 50 of the tube 40 is seated on the surface of the bottom wall 16 of the vessel 12. A deflector 52 is then fitted about the inlet 30 to deflect the incoming refrigerant downwardly toward the bottommost portion of the vessel 12. While many embodiments of the deflector may suffice, the preferred embodiment of the deflector 52 comprises a downwardly opened flare 54 having a circular opening 56 through its side wall 58. The side wall 58 includes a dovetailed slot 60 which mates with a corresponding dovetailed slide 62 connected to the inside surface of side wall 14. The deflector 52 is installed by mating the slot 60 with the slide 62 and sliding the deflector 52 downwardly along the side wall 14 of the vessel 12 until the circular opening 56 is concentric with inlet 30. A stop 64 is provided to secure the deflector 52 in position.

During use as a suction accumulator, the refrigerant which may contain liquid, flows into the vessel 12 via inlet 30 and is deflected downwardly by deflector 52. The gaseous component of the refrigerant flows upwardly and then into evaporator tube 40 to exit the vessel 12 via outlet 32. All of the liquid refrigerant remains in the bottommost portion of the vessel 12 because of its inability to flow into the evaporator tube 40 and exit the vessel 12 via outlet 32. An oil return orifice 66 may be provided to return any accumulated oil to the system.

Figure 3:
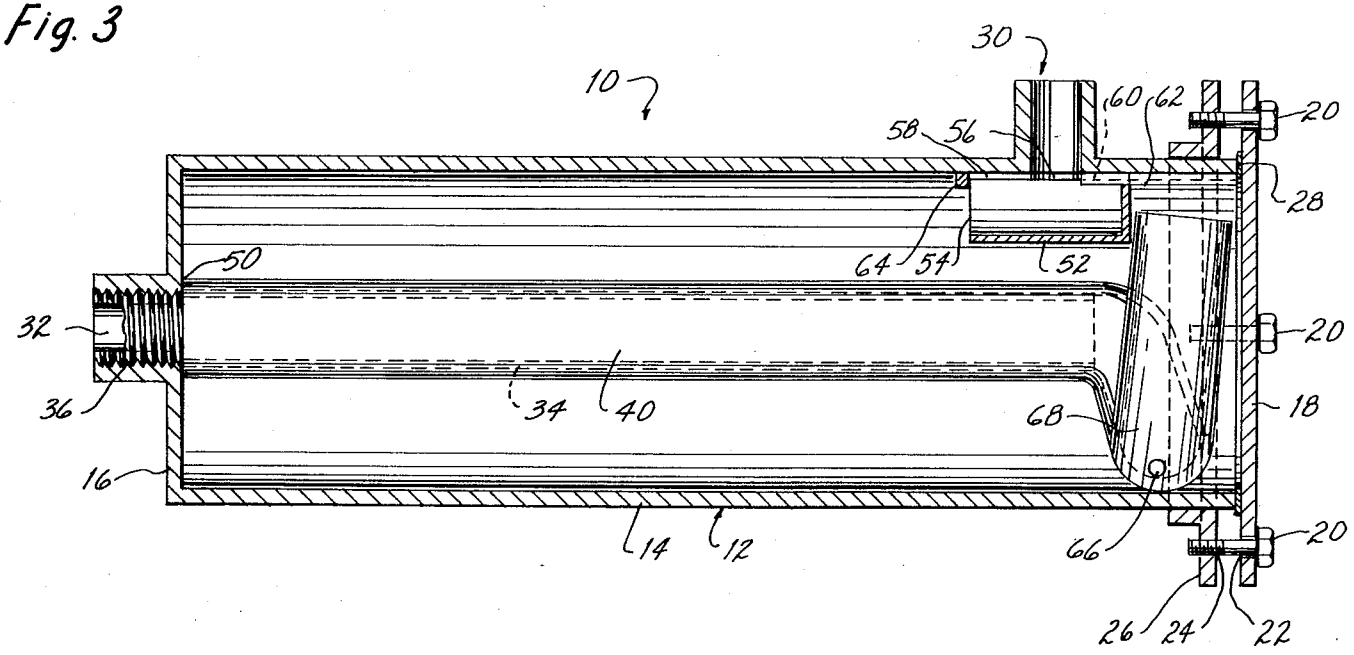
FIG. 3 is a longitudinal cross-sectional view of another embodiment of the device of the invention operable with a horizontally disposed evaporator tube.

As shown in FIG. 3, the device 10 of the invention, operating as a suction accumulator, may be designed to operate in a horizontal position, rather than a vertical position discussed above. In this regard, the evaporator tube 40 includes a generally U-shaped end 68 with its terminal end positioned appreciably close to the uppermost portion of vessel 12. The oil return orifice 66 is in the bottommost portion of the U-shaped end 68. It is apparent that this other embodiment of the device 10 of the invention functions similar to that of the first embodiment in that when employed as a suction filter-drier, the orientation is irrelevant and when functioning as a suction accumulator, the accumulated liquid refrigerant is precluded from flowing out the vessel 12 because of the U-shaped end 68 of the evaporator tube 40.

Without departing from the spirit and scope of this invention, in both embodiments, the screen tube 34 may be eliminated when using filter cores 38 having sufficient internal rigidity. When eliminating the screen tube 34, the evaporator tube 40 is preferably secured into place by threaded engagement with thread 36 in outlet 32. In a somewhat similar manner, it is within the scope of this invention to dimension the evaporator tube 40 to be inserted within the screen tube 34 rather than being positioned over the screen tube 34. Finally, it is within the scope of this invention to increase the overall length of the vessel 12 and to provide means for storing all of the components of the device 10 within the vessel 12 such that none of the components will be inadvertently lost.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and combination and arrangement of parts may be resorted to without departing from the spirit of the invention.

Now that the invention has been described,

What is claimed is:

1. An interchangeable suction accumulator and filter-drier device, for use in conjunction with a vapor compression heat transfer system employing a circulating refrigerant, comprising in combination:

an open-ended vessel having an inlet and an outlet;

cover means for sealingly closing the opened end of said vessel;

a filter element;

a non-porous evaporator conduit;

means for removably installing said filter element within said vessel to filter the refrigerant flowing from said inlet to said outlet of said vessel; and means for removable installing said non-porous evaporator conduit in fluid communication with said outlet in said vessel to assure, when installed, accumulation of the liquid refrigerant in the bottom of said vessel, whereby the apparatus interchangeably functions as a suction filter-drier when the filter element is installed and as a suction accumulator when said evaporator conduit is installed.

2. The device as set forth in claim 1, further comprising a screen tube positioned concentrically with said outlet to provide support to said filter elements when installed in the device.

3. The device as set forth in claim 2, wherein said non-porous conduit is dimensioned to fit over said screen tube.

4. The device as set forth in claim 3, wherein said non-porous evaporator conduit is dimensioned to fit inside said screen tube.

5. The device as set forth in claim 1, further including deflector means for deflecting refrigerant flowing into said vessel via said inlet downwardly toward the bottom of said vessel.

6. The device as set forth in claim 1, wherein said outlet is positioned in a bottom wall of said vessel.

7. The device as set forth in claim 6, wherein said non-porous evaporator conduit is upstanding.

8. The device as set forth in claim 1, wherein said non-porous evaporator conduit is horizontally disposed when installed in said vessel and has an upturned end.

* * * * *